United States Patent [19]

Donohue

[11] Patent Number: 4,953,852

[45] Date of Patent: Sep. 4, 1990

[54] PUNCHING BAG AND SUPPORT

[76] Inventor: Patrick T. Donohue, 1822 NE. 143rd, Portland, Oreg. 97230

[21] Appl. No.: 186,453

[22] Filed: Apr. 26, 1988

[51] Int. Cl.[5] ..... A63B 69/00

[52] U.S. Cl. ..... 272/78; 272/77

[58] Field of Search ..... 272/76, 77, 78, 130, 272/71; 84/327; 446/222, 220, 221, 224; 273/65

[56] References Cited

U.S. PATENT DOCUMENTS

| | | | |
|---|---|---|---|
| 445,747 | 2/1891 | Cook | 272/77 |
| 600,777 | 3/1898 | Frazier . | |
| 758,279 | 4/1904 | Rhodes . | |
| 923,379 | 6/1909 | Selfe | 272/77 |
| 1,119,635 | 12/1914 | Reach . | |
| 2,143,691 | 1/1939 | Goldberg et al. | 272/78 |
| 2,186,403 | 1/1940 | Bullis et al. | 272/78 |
| 2,323,624 | 7/1943 | Schall | 272/78 |
| 2,510,883 | 6/1950 | Goldberg | 272/78 |
| 2,625,770 | 1/1953 | Steen et al. | 446/221 |
| 2,815,952 | 12/1957 | Glasberg et al. | 272/78 |
| 3,226,116 | 12/1965 | Klingler | 272/78 |
| 3,622,116 | 11/1971 | Fellows | 248/467 |
| 4,176,580 | 12/1979 | Gallegos | 84/327 |
| 4,660,831 | 4/1987 | Kralik | 273/65 |
| 4,729,749 | 3/1988 | Milne | 446/222 |

FOREIGN PATENT DOCUMENTS 4359 of 1886 United Kingdom .

*Primary Examiner*—Stephen R. Crow
*Attorney, Agent, or Firm*—Bruce J. Ffitch

[57] ABSTRACT

In a light duty punching bag and mounting arrangement, the bag is made from two balloons. A first balloon is inflated inside another, the two uniting to form a durable suitably resilient bag. Basis for suspension of the bag is a collar sandwiched between the walls of the two balloons and held there by a clamping force resulting from inflation pressure. Articulated connection to an overhead rebound board is by a short flexible tube and a ball pivot in tandem. These help produce a desirable rebounding characteristic, close to that of a professional punching bag. Several mounting methods are disclosed including at least one which provides a convenient height adjustment.

22 Claims, 2 Drawing Sheets

PUNCHING BAG AND SUPPORT

BACKGROUND OF THE INVENTION

This invention concerns exercise, recreational and training devices utilizing a suspended or tethered inflatable ball, and more particularly, a punching bag and its support.

There are many common desiderata in the performance characteristics and construction of tethered game or exercise balls or bags, but for simplicity the following discussion will be limited to punching bags, sometimes called striking bags.

The general form of the conventional punching bag is well-known. An approximately pear-shaped bag is suspended from a rebound board or platform fixed at such a height above the floor that an erect "boxer" can comfortably sustain a steady regular series of strikes (a volley) on the bag. Bag and board are designed to produce, in combination, a desired coefficient of restitution or "bounce" of the bag from the board. For typical conventional and professional punching bags, this bounce corresponds to a rebound to strike ratio range of between three and six to one.

In a typical conventional bag an inflatable bladder is contained in a relatively stiff and heavy leather casing. Consistency of rebound characteristic is achieved in part by suspending the bag from the board by a short flexible suspension, the lower end of which is attached substantially rigidly to the bag casing. That is, the attaching element at the bag is substantially fixed with respect to the bag itself. Between this bag attachment point and the rebound board the flexible connection usually provides at least two effective hinge points. The suspension is not a simple swivel so that the bag swings simply radially with respect to the board, but rather a compound hinge which permits the bag to "rock" as well as swing when struck, and also to rock relative to the rebound board upon impacting the board.

At the suspension attachment point the bag may be reinforced by inserting a domed or conical collar into the neck of the bag and lacing or clamping the bag neck over it. The collar then provides a relatively inflexible attaching point for the bag. See for example U.S. Pat. Nos. 600,777 Frazier, 758,279 Rhodes, 1,119,635 Reach and 2,815,952 Glasberg.

The flexible suspension may include combinations of elements such as a ball swivel and loops or rings of metal or leather, or may comprise a short cord of rubber or other flexible material. See for example Reach and U.S. Pat. Nos. 2,323,624 Schall and 3,226,116, Klingler.

Conventional and professional punching bags are relatively heavy and expensive. Because of the forces and shock loads developed, even in normal use, mounting arrangements must be heavy duty so that the installation is essentially permanent and not readily made portable. To avoid damage to the hands boxing gloves must be worn. For these and other reasons the market for the conventional suspended punching bag is well-defined and quite limited.

Some attempts have been made to make punching bag action available to a wider public, including children. But in general these have been more successful in visual simulation of the conventional punching bag than in a functional reproduction of its desirable characteristics as outlined above. See for example the punching bag included in a free-standing exercise kit offered by the toy retailer, Toys R Us. TM See also Klingler. A related disclosure is that of the Goldberg's in U.S. Pat. Nos. 2,143,691 and 2,510,883. These describe floor mounted rather than suspended "punching bags" and consist simply of an inflated balloon clipped to the upper end of a flexible standard. There is no serious attempt to make a stiff connection of the balloon to the standard or to reinforce the balloon wall. In general the action provided by known scaled-down light duty or toy versions of punching bags has been disappointing, particularly in their failure to provide a satisfactory volley action. A typical defect is their use of a soft, inelastic casing. Such casings, in lighter or toy punching bags, produce poor bounce, are relatively expensive, and comparatively heavy.

SUMMARY OF THE INVENTION

Accordingly, it is an object of the invention to provide a simple light duty exercise device or toy which, even though lighter, approximates the rebound or volley action of a full sized or professional punching bag, and which is potentially low in manufacturing cost so as to be attractive to and affordable by a larger segment of the population.

It is a further object that a device according to the invention should be easily portable and adaptable to temporary mounting at adjustable heights on a variety of vertical surfaces.

In a preferred embodiment the punching bag comprises two similar elastic bags, including an inner inflatable one and a second encasing it so that inflation of the one distends the other. A rigid unitary neck and collar member, similar in shape to the upper portion of a bottle, is positioned over the inflation neck of the inner bag so that, upon inflation, its collar or skirt is trapped between the outer and inner bags, effectively uniting the rigid neck with the double walled inflated sack. The inflation point or neck of the inner sack may be accessible through the open neck of the unitary neck and collar member, for control of inflation or deflation.

A slender flexible element, such as a latex rubber tube may be connected between the rigid neck and a swivel element such as a ball, pivotably supported by the rebound board of the platform. If an elastic tubular member is used it is preferably connected by its frictional engagement of pegs extending from the neck and from the swivel element respectively and inserted into the tube. At least one of the pins may be tapered so that the tube is releasable from it when a predetermined tension in the tube is exceeded, thus providing overload protection for the device.

It is a feature of the invention that punching bags according to the invention may have performance characteristics such that satisfying volley activity can be maintained at a comfortable frequency even though the mass of the bag is much less than that of a conventional punching bag.

In a preferred embodiment the bag may be constructed of a pair of conventional helium balloons of six or seven inches nominal diameter. The smoothness of surface and lightness of such a bag means that it can be used without boxing gloves.

It is another feature of the invention that the principal components susceptible to wear or damage, the bag and flexible suspension elements, may both be quickly and easily replaced at very low cost.

Another feature of the invention is that its lightness and simplicity makes it adaptable to a variety of methods for mounting the bag and platform on a vertical surface. These may include a multiple suction cup arrangement, or vertically tapered brackets attached to the vertical mounting surface for mating with similarly tapered members carried by the punching bag platform. The latter may be tapered both upwards and downwards so that an adjustment in mounting height of the punching bag may readily be obtained simply by inverting and reseating the platform and rehanging the bag from the opposite side of the platform.

Other features and advantages of the invention will become apparent from the following description read in conjunction with the drawings.

Description Of The Preferred Embodiment

Figure 1:
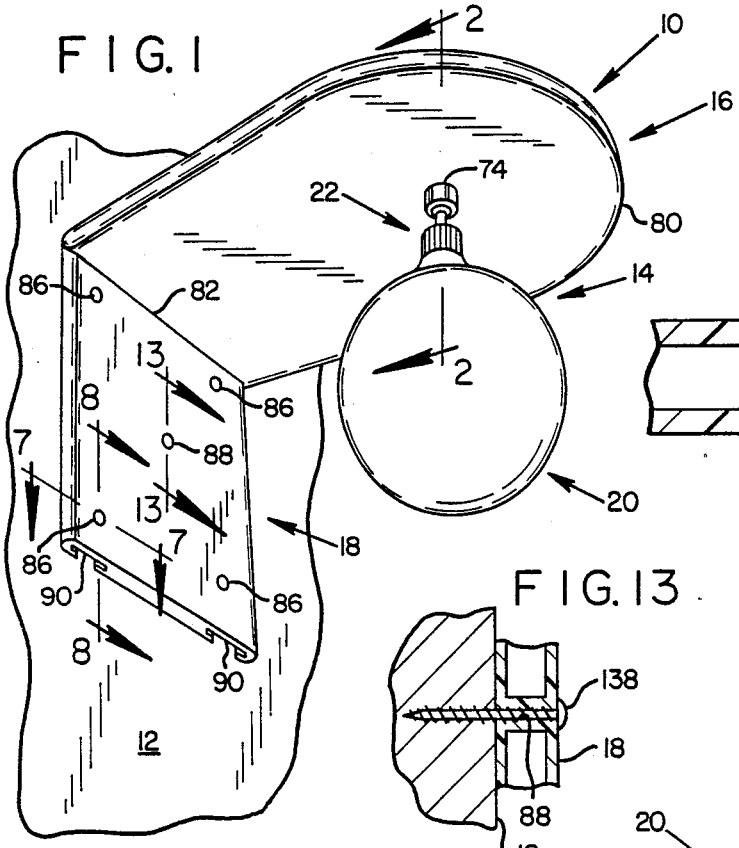
FIG. 1 is a three quarters perspective view from below of a punching bag and support according to the invention as it would appear when mounted on a vertical surface.

The invention is embodied in the punching bag assembly 10 mounted on a vertical surface 12 and shown in its entirety in FIG. 1. The principal components of the punching bag assembly 10 are a bag assembly 14 depending from a rebound platform 16, the whole being supported and mounted on the vertical surface 12 by a mounting plate 18.

Figure 2:
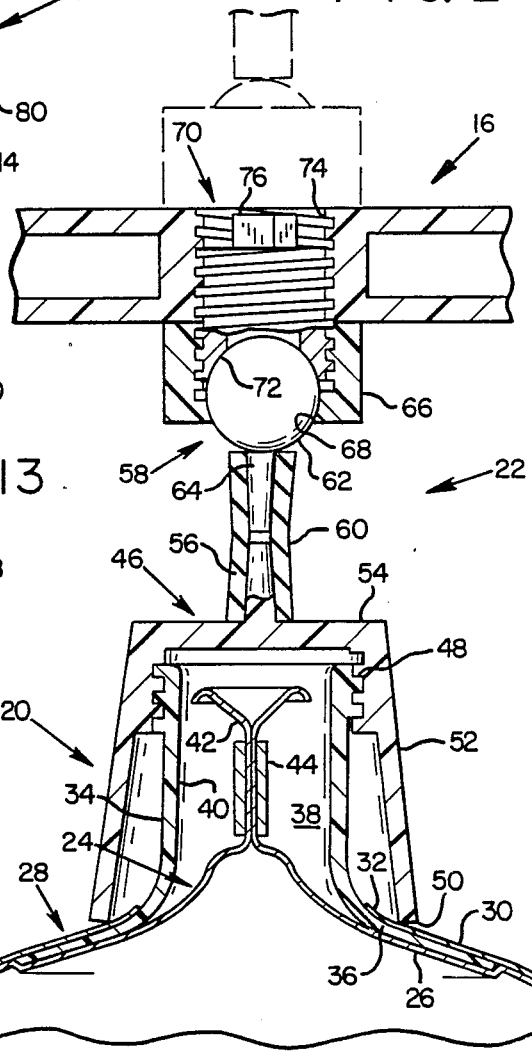
FIG. 2 is an enlarged, partial cross sectional view taken approximately on line 2—2 of FIG. 1, and showing in some detail the suspension of the punching bag from the rebound platform.

In the punching bag assembly 14, a bag subassembly 20 is suspended from the platform 16 by a suspension assembly 22. The bag subassembly 20 is essentially a double walled inflatable ball in which an inner member or bladder 24 having, when inflated, a generally spherical wall 26 distends an enveloping outer member or casing 28 having, when inflated, a generally spherical wall 30. (FIG. 2) Preferably bladder 24 and casing 28 are of similar elastic material. Good results have been obtained when helium balloons of six or seven inches nominal diameter have been used for both components. When a conventional balloon is used for the outer member or casing 28, it may be modified, if necessary for easier assembly, by severing its inflation neck so as to leave a generally circular aperture 32 as shown in FIG. 2;

The bag subassembly 20 is completed by a balloon collar 34 which provides the attachment point for the bag subassembly 20. In assembly the collar 34, which is preferably of a lightweight material such as plastic, is inserted through the aperture 32 of casing member 28 or through the orifice of the inflation neck when an unmodified balloon is used for the casing so that a portion of the wall 30 is supportable by a skirt portion 36. The inner member or bladder 24 is then inserted through the tubular orifice 38 of the neck portion 40 of the collar with its inflation neck 42 remaining accessible in the orifice 38. The bladder 24 is then inflated in a conventional way, as by mouth, and the inflation secured by some suitable means such as clip 44. As seen best in FIG. 2, inflation of the bladder 24 and the consequent distending of the casing member 28 sets up a tension in the respective walls 26, 30, so that the skirt portion 36 of the collar 34 is effectively and securely clamped between them. In the inflated condition the walls 26, 30 are in substantially continuous contact and become as one and the collar 34 becomes integrated with them to provide a substantially rigid attaching point for the bag subassembly 20.

The connection between bag subassembly 20 and the suspension subassembly 22 is made by a frusto-conical screw cap 46 which engages corresponding screw threads 48 at the upper end of the balloon collar neck 40. In assembly the cap 46 is screwed down until the lower edge 50 of its frusto conical wall 52 firmly, but gently, engages the casing wall 30 so as to augment the security of casing wall 30 on the skirt 36 and thus the clamping hold on the collar 34, jointly by the bladder 24 and the casing 28. Extending centrally from the top 54 of the cap 46 is a tapered pin 56.

The suspension subassembly 22 comprises two "flexible" or hinge elements in tandem, a ball and socket swivel 58 and a short length of flexible elastic tubing 60. In the ball and socket swivel, the ball 62, which has an integral downwardly extending tapered peg 64, is retained by a cap 66 which includes in its base a suitably sized seat 68 for the ball. The ball and socket swivel is completed by a screwed plug 70 which is screwed into the cap 66 and also has a seat 72 engageable by the ball 62. The plug 70 extends sufficiently from the cap 66 for adequate engagement of the correspondingly threaded through hole 74 in the rebound platform 16. A protuberance 76 from the top of the plug 70 of some suitable shape, such as a flat or a square, provides a means for gripping the plug 70 to rotate it when it is engaged in the platform 16.

The flexible tube 60 forms a releasable connecting link between the bag 20 and the platform 16. The tube 60 and tapered pegs 56, 64 are sized so that in pushing the tube onto the pegs it is stretched sufficiently to grip the pegs. The tapers progressively distend the tubing.

The platform 16 is a simple flat board with a radiused end 80, centered approximately on the mounting hole 74, and a square inner end 82 connected rigidly to the mounting plate 18.

Figure 4:
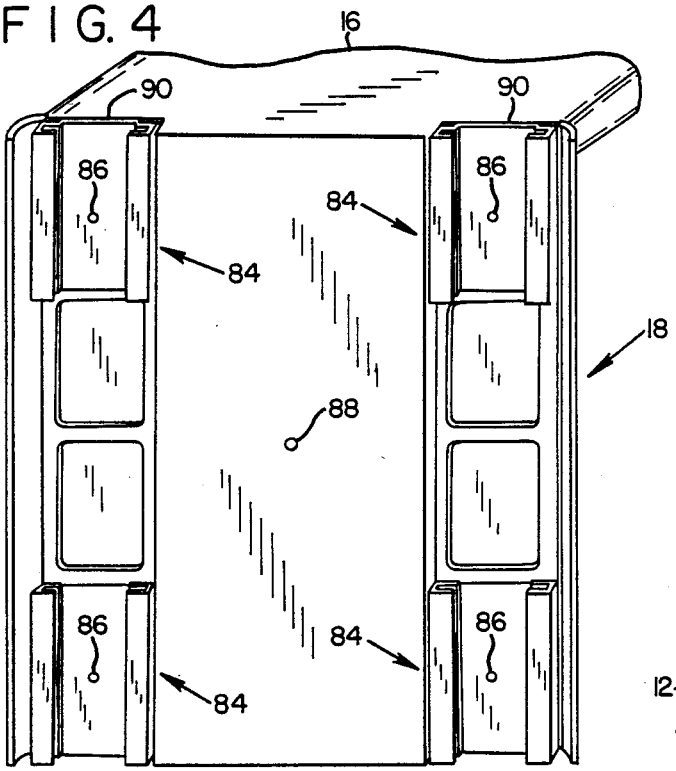
FIG. 4 is an enlarged partial rear perspective view of the support showing the double taper mounting members used in one of the mounting options.

In the present embodiment the mounting plate 18 is designed to accommodate a number of different methods of attaching the complete punching bag assembly 10 to the upright surface 12. The basis in mounting plate 18 for the various mounting methods includes four double tapered mounting brackets 84, one at each corner of the plate 18, and five through holes - corner holes 86 and center hole 88. (FIGS. 1 and 4). The mounting brackets 84 are mounted within a pair of opposite lateral upright mounting channels 90.

Figure 5:
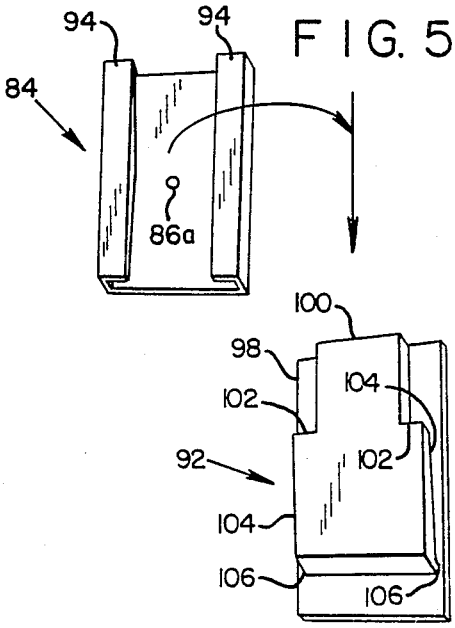
FIG. 5 is a combination perspective/schematic of one of the four (corner) mounting elements shown in FIG. 4 indicating its relationship to a receiving tapered element for mounting on the vertical surface.
Figure 7:
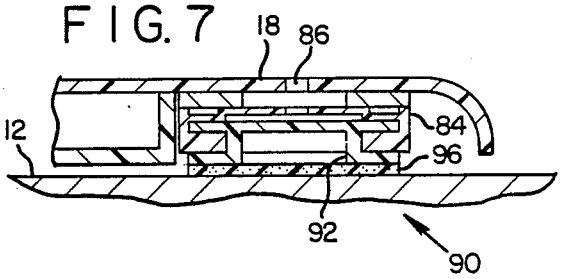
FIG. 7 is an enlarged cross sectional view taken approximately on line 7—7 of FIG. 1 with the mounting embodiment of FIG. 5 in use and engaged.
Figure 8:
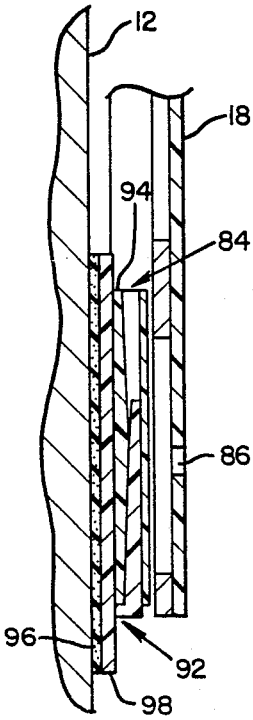
FIG. 8 is an enlarged cross sectional view taken approximately on line 8—8 of FIG. 1, again showing the relationship in use of the mounting components of FIG. 5.

The mounting bracket 84 and the mounting socket 92 with which it engages or mates, are shown in more detail in FIGS. 5, 7 and 8. Bracket 84 is symmetrical about its horizontal line on which through hole 86*a* lies. The bracket 84 is of flanged channel cross section, the flanges 94 tapering equally to a maximum thickness at the horizontal center line. Receiving socket 92 may be mounted on the desired upright surface (12) by any suitable method such as the adhesive foam rubber backing 96, shown in FIGS. 7 and 8. The socket member 92, seen best in FIG. 5 is symmetrical about a vertical center line. Functional elements are carried on a rectangular base plate 98 and include a central guide tongue 100 and opposite tapered flanges 102 which, together with base plate 98, define a pair of lateral downwardly tapering sockets 104, each terminated by a bottom stop 106.

Figure 6:
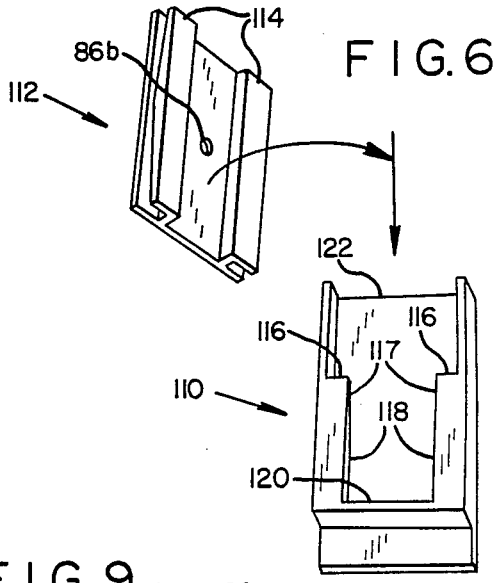
FIG. 6 is a view similar to FIG. 5 of an alternative embodiment of a similar mounting arrangement.
Figure 9:
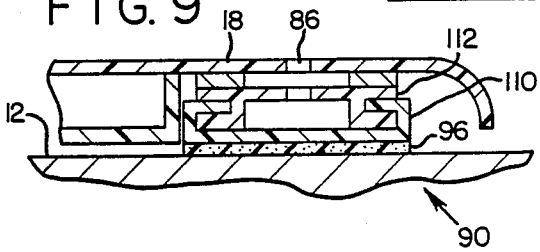
FIG. 9 is a view similar to FIG. 7 showing the engaged relationship of the mounting components of FIG. 6.

In the alternative embodiment of FIG. 6, members with matching tapered elements are again used. In this case, the double tapered flanges 114 of mounting plate mounted member 112 are directed outwards, but the member is still symmetrical about a horizontal center line on which through hole 86*b* lies. Correspondingly, the tapered flanges 116 of wall mounted member 110 are directed inwards, separated by a guide slot 117. Tapered pockets 118 (partly defined by base plate 122) face each other and share a common bottom or limiting member 120. FIG. 9 is a horizontal cross sectional view showing the members 110, 112 of FIG. 6 in engagement.

Figure 13:
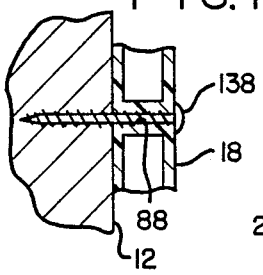
FIG. 13 is an enlarged cross sectional view taken approximately on line 13—13 of FIG. 1, showing a detail of a further mounting arrangement.
Figure 10:
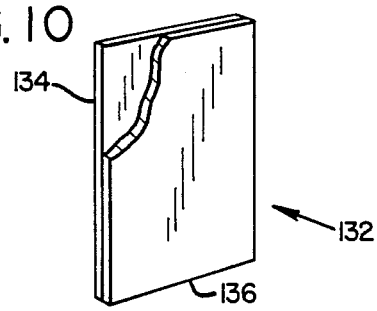
FIG. 10 is a cut away perspective view of a mounting pad for providing a smooth surface on a rough or porous wall.
Figure 12:
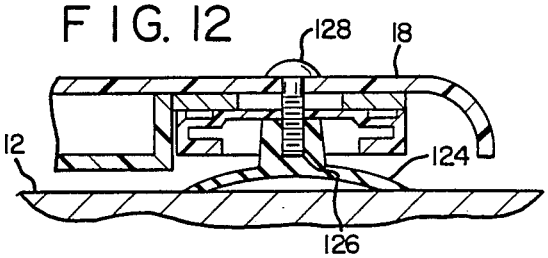
FIG. 12 is a view similar to FIG. 11 of a mounting arrangement omitting the pad of FIG. 10.
Figure 11:
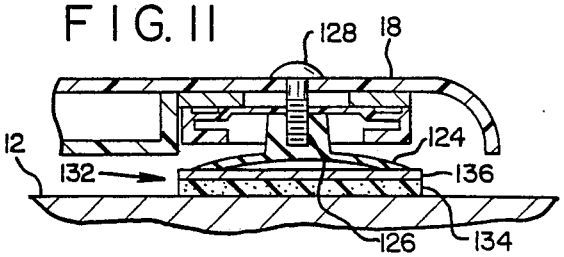
FIG. 11 is a cross sectional view similar to FIG. 7 showing an alternative mounting arrangement including the mounting pad of FIG. 10.

Another alternative mounting arrangement, by suction cup, is shown in FIG. 12, with a variation indicated in FIGS. 10 and 11. In the exemplary suction cup arrangement shown in FIG. 12, suction cup 124 is secured to the back of mounting plate 18 by screw 128 passing through mounting hole 86 to engage a threaded insert 126. Preferably four suction cups are used, one at each corner. When the surface condition of upright mounting surface 12 permits, suction cups 124 may be applied directly to it as shown in FIG. 12. On a rougher or porous upright mounting surface, suction cups 124 may still be used with the help of mounting pad 132 (FIGS. 10 and 11). By means of an adhesive foam rubber backing 134, a smooth mounting plate 136 of plastic or other suitable material is attached at an appropriate point on the mounting surface. The holding capacity of suction cups (124) may be augmented by a single screw 138 through the central hole 88 of mounting plate 18, as shown in FIG. 13.

A method of assembling the punching bag subassembly 20 has been described above. In addition it should be noted that, for a given size of balloon used for the bladder 24 and the casing 28, inflated diameter may be adjusted to vary the speed of rebound, to "fine tune" the punching bag for a particular user, or for other reasons. For a given inflation pressure (inflated diameter) rebound speed or frequency is about the same, whether two balloons of the same nominal size are used or whether a larger balloon is used for the casing 28. However, the latter is preferred because it has been found to be a somewhat more durable combination.

In assembly, the tubular element 60 of the suspension is simply pushed onto the pegs 56, 64 as shown in FIG. 2. For best rebound action it is important to maintain a gap between the tips of the pegs 56, 64, as shown in FIG. 2. The material of the tube 60 must be flexible and sufficiently elastic to maintain an adequate grip when stretched over each peg. It should also have a good memory characteristic, so that after deflection it always tends to return to a straight alignment. Latex rubber tubing is preferred.

Good action of the punching bag depends in part on a smooth, low friction action of the ball and socket swivel assembly 58. Preferably a low friction material such as high density polyethylene or teflon is used for the ball 62, cap 66 and threaded plug 70. This may give satisfactory results even without lubrication. To avoid vibration in operation, ball clearance must be kept to a minimum. Before assembly to the platform 16, ball clearance may be adjusted by rotating the threaded plug 70 in the cap 66, as required. Preferably there is a light interference fit between the threads of the plug 70 and those of the cap 66, so that this adjustment is maintained when the assembly is screwed into the platform 16. When tightened down against the surface of the platform 16, the cap 66 serves a jam nut, locking in the ball adjustment. If necessary, fine adjustment of ball clearance can be made by loosening the "jam nut" (cap 66) and turning the threaded plug 70 by means of the central protruberance 76 on its top.

Figure 3:
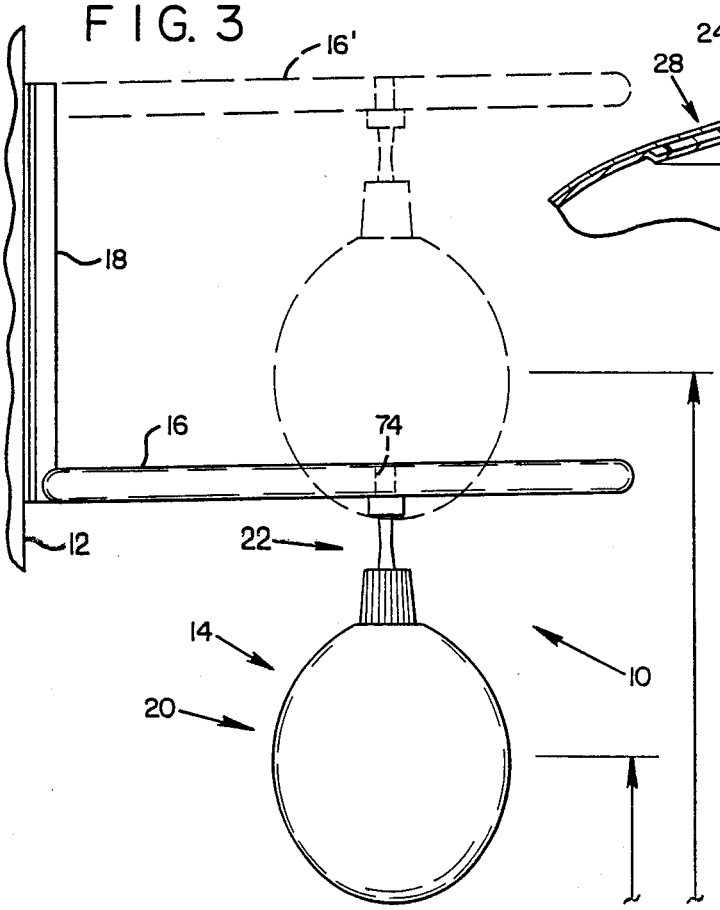
FIG. 3 is a side view of the punching bag and support mounted on a vertical surface and indicating the height adjustment which may be obtained by inverting the support.

As indicated in FIG. 3, for a given location of attachment points on a vertical surface (12), two basic punching bag height adjustments are available, depending on whether the punching bag assembly 10 is mounted with the platform 16 at the top or at the bottom in relation to the mounting plate 18. The threaded through hole 74 in the platform 16 accepts the suspended bag assembly readily from either side. The two position basic height adjustment is available with any one of the mounting methods described above, including variations on the double tapered bracket arrangement shown in FIGS. 5 and 6. The upwards and downwards facing tapered flanges of the brackets 84, 112, carried by the mounting plate 18 mean that the socket members 92, 110, will accept the brackets whichever way up the punching assembly is. Dimensions of the pairs of mating members 84, 92 and 112, 110, respectively, are such that when the bracket is fully seated in the socket it is approximately centrally disposed between the top and bottom of the base plate (98, 122) of the socket member as it adheres to the upright surface. Thus any horizontal loading on the socket member by the bracket is uniformly, or at least centrally, distributed minimizing any tendency for the foam rubber backing (96) to be stripped from the wall.

The mounting methods described are generally simple to use and involve a minimum of disturbance of the mounting surface (12). In the bracket and socket method, guide portions of the sockets (tongue member 100 in socket 92, FIG. 5 and guide slot 117 in socket member 110, FIG. 6), facilitate aligning and entering of the bracket members into the sockets. Adhesive foam rubber, as may be used in the mounting embodiments of FIGS. 5, 6 and 11 is easily and cleanly removed from the upright mounting surface 12 by conventional methods. As suggested above, additional security of mounting may be obtained by the use of a single screw (FIG. 13), in the center of the mounting plate 18. Used, for example, in conjunction with suction cups as shown in FIG. 12, a secure cushioned mount is obtained at the expense of only one screw hole in the mounting surface 12.

The operation and mode of use of the relatively heavy duty conventional or professional punching bags is well known. If they are well-designed and reliable in operation they permit sustained volleying (regularly repeated striking - each strike producing multiple bounces of the bag from the rebound platform). It is a feature of the present invention to provide similar action in a punching bag assembly which is of much lower overall weight and cost and which may be conveniently and temporarily mounted. The combination of relative sophistication in design and action with simplicity and relatively low potential selling price, of gentle and convenient mounting methods with adjustable height and absence of requirement for supporting equipment (no gloves are needed), make punching bags according to the invention attractive to, and usable by, people of a wide range of age and stature.

Maintenance costs are also low. The principal wearing elements, bladder 24, casing 28 and suspension tubular member 60 are all cheaply and easily replaced.

In the present invention, two balloons with their captive collar and the double hinge action of the suspension system, are transformed into a realistic punching bag. In spite of the low mass of the bag and suspension system (and also of the mounting arrangement) ratios of strike to rebound in the same range as professional bags (between 3 and 6 to 1) can readily be obtained. Consistent rebound action permits performance of some of the standard punching bag maneuvers including figure eights and "fist over fist". Consistency of performance in this low mass punching bag results in part from the use of the fixed low friction ball and socket swivel as the main pivot of the suspension, working in cooperation with the flexible tubular member (60). The latter permits deflection of the bag from its pure radial dependence from the pivot ball at appropriate points in the cycle, including impact from the striking fist and with the rebound board. Another factor in good rebound action is the predictably uniform resilience of the bag with its effectively unitary elastic wall. And the user can "attack" the bag with gusto, secure in the knowledge that, if he awkwardly mis-hits, the suspension (flexible tube 60 on pegs 56, 64) will release the bag without damage to the mounting structures.

I claim:

1. A punching bag assembly comprising:

a first bag, inflatable and having a wall of a first elastic material and an inflation orifice;

a second bag having a wall of a second elastic material and an opening in the wall, said first and second materials having substantially similar material properties, the first bag being contained within the second bag with the inflation orifice in register with the opening and inflated so that it exerts pressure outwards and distends the second bag, the elasticity of the materials helping to establish a tension in the walls of both bags so that said walls substantially unite to define a single resilient envelope; and suspension means having a collar including an orifice and disposed in the opening of the second bag so as to be captured by the bags upon inflation of the first bag and retained between said walls by the tension established in the respective walls so that the opening of the second bag is distended elastically over the collar and the suspension means is substantially integrated with the walls and the first bag inflation orifice is accessible through the collar orifice.

2. The punching bag assembly of claim 1 wherein the suspension means includes an articulated connection comprising, in tandem, a universal swivel and a short flexible element.

3. The punching bag assembly of claim 2 wherein the universal swivel comprises a ball and socket.

4. The punching bag assembly of claim 2 wherein the flexible element is an elastic tube.

5. The punching bag assembly of claim 1 wherein the first and second bags comprise similar inflatable balloons.

6. A punching bag for suspension when in use comprising:

an inflatable elastic bag, an elastic casing for surrounding the inflatable bag and having a wall and an opening in the wall;

an adapter including a neck having an outer end and an inner end, and a skirt extending outwardly and substantially concentrically from the inner end; and, in assembly, the adapter being inserted into the casing with the neck emerging from the casing opening and the bag being inserted into the casing, bag and casing being sized so that when the bag is inflated it distends the casing so that the skirt of the adapter is retained between bag and casing.

7. The punching bag of claim 6 and including an attachment cap for capping the neck of the adapter and means for securing the attachment cap to the adapter and a suspension connection element extending from the cap.

8. The punching bag of claim 7 wherein, in assembly, the attachment cap may be manipulated to bias the casing against the skirt of the adapter.

9. The punching bag of claim 7 wherein the means for securing the cap includes mating screw threads on the tubular neck of the adapter and on the attachment cap.

10. The punching bag of claim 6 wherein the inflatable bag and the casing are both made from a similar imperforate elastic material and wherein in assembly the inflatable bag is inflated so that casing and bag are substantially contiguous overall, so as to define a substantially unitary resilient ball.

11. The punching bag of claim 6 wherein in assembly, with the bag inflated, the retention of the skirt of the adapter between bag and casing depends entirely on the inflation of the bag.

12. A punching bag and suspension comprising, in combination:

a punching bag including an inflatable elastic bag and an elastic casing for enveloping the bag so that when the bag is inflated the casing is brought into intimate contact with the bag;

a connecting collar including a connecting portion and a skirt portion depending from the connecting portion, the collar being disposed so that upon inflation the skirt is held between the bag and the casing and the connecting portion is directed generally radially outwards from the punching bag;

a peg carried by the connecting portion and in assembly extending generally radially from the punching bag;

a ball and socket pivot, including a ball having a radially extending peg and a socket for attachment in a depending relationship to a generally horizontal overhead surface, so that the ball may be retained in the socket with the peg extending downwards; and a flexible connecting element comprising a short length of elastic tubing having opposite open ends, the first and second pegs being insertable, one each in the opposite open ends of the tubing, tubing and pegs being sized so that the tubing grips the pegs sufficiently to maintain the punching bag connected to the overhead surface during normal punching bag operation.

13. The punching bag and suspension of claim 12 wherein, when the punching bag is suspended from the overhead surface, the connecting element is in tension and wherein the elastic tubing and the first and second pegs are sized so that the tubing is released from at least one of the pegs, when a predetermined tension is exceeded.

14. The punching bag and suspension of claim 12 wherein at least one of the first and second pegs is tapered so that progressive insertion of said peg into an open end of the elastic tubing increasingly distends said tubing.

15. A punching bag and mounting comprising, in combination:

a punching bag including an inflatable elastic bag and an elastic casing enveloping the inflatable bag, so that when the bag is inflated the casing is distended and conforms to the shape of the bag;

a platform for suspending the punching bag and having means for releasably mounting the platform on an upright surface; and articulated suspension means extending between the platform and the bag for swingably suspending the bag and including, in tandem arrangement, a swivel having a pivot center and a short normally linear flexible element.

16. The punching bag and mounting of claim 15 wherein the pivot center of the swivel is retained in a fixed relationship to the platform.

17. A method of making a punching bag comprising the steps of:

procuring first and second similar balloons, each having an inflation neck defining an orifice;

b. inserting a stiff collar having a central aperture into the inflation neck of the first balloon so that the orifice of the first balloon and the aperture of the collar register, and so that the wall of the balloon overlaps the collar;

c. inserting the second balloon through the aperture of the collar;

d. inflating the second balloon so that it distends the first balloon and so that inflation pressure is sufficient to secure the collar between the walls of the first and second balloons; and e. suspending the punching bag by connecting the collar to a fixed support.

18. The method of claim 17 wherein the step of suspending the punching bag includes attaching a cap to the collar and the further step of adjusting the cap so as to create an additional biasing of the wall of the first balloon onto the collar.

19. The method of claim 18 wherein the step of connecting to a fixed support, includes connecting the cap to said support.

20. The method of claim 18 wherein the step of suspending the punching bag includes connecting a flexible element and a swivel in tandem between the collar and the fixed support.

21. The method of claim 17 including the additional step of removing the inflation neck from the first balloon so as to enlarge the orifice of said balloon.

22. The punching bag of claim 10 wherein the inflatable bag and the elastic casing comprise similar inflatable balloons.

* * * * *